US007187890B2

(12) United States Patent
Nishida

(10) Patent No.: US 7,187,890 B2
(45) Date of Patent: Mar. 6, 2007

(54) ION CONDUCTIVE ROLLER AND IMAGE FORMING APPARATUS EMPLOYING ION CONDUCTIVE ROLLER

(75) Inventor: Satoshi Nishida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/807,105

(22) Filed: Mar. 24, 2004

(65) Prior Publication Data

US 2004/0228659 A1 Nov. 18, 2004

(30) Foreign Application Priority Data

Mar. 26, 2003 (JP) ..... 2003-084975
Mar. 10, 2004 (JP) ..... 2004/067444

(51) Int. Cl.
*G03G 15/00* (2006.01)

(52) U.S. Cl. ..... 399/179; 399/280

(58) Field of Classification Search ..... 399/179, 399/280, 281, 282, 283, 284, 285, 286; 430/66
See application file for complete search history.

(56) References Cited

U.S. PATENT DOCUMENTS 6,335,133 B1 * 1/2002 Nagasaka ..... 430/64
6,337,165 B1 * 1/2002 Fujii et al. ..... 430/58.05
6,806,009 B2 * 10/2004 Tanaka et al. ..... 430/66
6,873,816 B2 * 3/2005 Akashi et al. ..... 399/286
2004/0131373 A1 * 7/2004 Saito et al. ..... 399/66

FOREIGN PATENT DOCUMENTS

JP 11-109770 4/1999

OTHER PUBLICATIONS

English Translation of Japanese Patent Appln. Publication No. JP 11-109770 Hiroko et al.).

* cited by examiner

*Primary Examiner*—Brij B. Shrivastav
(74) *Attorney, Agent, or Firm*—Fitzpatrick, Cella, Harper & Scinto

(57) ABSTRACT

An image forming apparatus includes a movable member; a roller contacted to the movable member, the roller having an elastic layer contacted to the movable member, the elastic layer having an ion electroconductivity and having a hardness of not less than 20° and not more than 50°, wherein the hardness and a density of the elastic layer satisfy (hardness/density)≧65, wherein the hardness is an Asker-C hardness of a material of the elastic layer cut out into a thickness of 4.0 mm under a weight of 500 g applied to the material.

22 Claims, 5 Drawing Sheets

ION CONDUCTIVE ROLLER AND IMAGE FORMING APPARATUS EMPLOYING ION CONDUCTIVE ROLLER

FIELD OF THE INVENTION AND RELATED ART

The present invention relates to an image forming apparatus such as a printer, a copying machine, a facsimileing machine, etc. In particular, it relates to an apparatus employing an ion conductive roller.

An image forming apparatus such as an electrophotographic copying machine, a laser beam printer, etc., employs an electrophotographic photosensitive member (which hereinafter will be referred to simply as photosensitive drum), and a plurality of processing means such as a charging means, an exposing means, and a developing means, to form a toner image, as a transferable image, in accordance with image formation data. The toner image is transferred onto transfer medium with the use of a transferring means. Then, the transfer medium is introduced into a fixing means, in which the toner image is thermally fixed to the surface of the transfer medium, becoming a permanent image. After the fixation of the toner image, the transfer medium is outputted as a finished product (copy, print).

After the transfer of the toner image onto the transfer medium, the photosensitive drum is cleaned; the residues such as the toner particles, paper dust, etc., remaining on the peripheral surface of the photosensitive drum are removed. Then, the photosensitive drum is used again for an image formation process; it is repeatedly used for an image formation process.

Before the photosensitive drum is exposed, the entire range of the photosensitive drum in terms of its lengthwise direction is charged. As the means for charging the photosensitive drum, those employing a charge roller have come to be widely used in recent years. A charge roller is placed in contact with a photosensitive drum; it is a contact type charging member. As voltage is applied to the charge roller in contact with the photosensitive drum, the photosensitive drum is electrostatically charged in the charging station, or the contact area between the peripheral surfaces of the photosensitive drum and charge roller.

As for the means for transferring a toner image from a photosensitive drum, a transferring means employing a so-called transfer roller, which is of a rotational contact type, has come to be widely used because of its advantage that not only can the employment of a transfer roller simplify the transfer medium conveyance path, but also it can stabilize the transfer medium conveyance. The transfer roller is placed in contact with the photosensitive drum, forming the transfer medium nipping portion, or transfer station, between the peripheral surfaces of the transfer roller and photosensitive drum. In operation, transfer medium is conveyed through the transfer station while voltage is applied to the transfer roller, so that a toner image on the peripheral surface of the photosensitive drum is electrostatically transferred onto the transfer medium. The charge roller and transfer roller are both for charging objects, that is, photosensitive drum and transfer medium, respectively, and are electrically conductive.

Referring to FIG. 9, one of the recently proposed transfer rollers 116 comprises an electrically conductive metallic core 117, and an elastic and electrically conductive layer formed in a manner to wrap the peripheral surface of the metallic core 117. Transfer rollers 116 can be roughly divided into two types based on whether a transfer roller 116 is conductive of electrons or ions: (1) electron conductive type and (2) ion conductive type.

Referring to FIG. 9, an electron conductive transfer roller (1) is provided with an elastic layer 118, in which electrically conductive filler has been dispersed. For example, there is an electron conductive roller, in the elastic layer of which electrically conductive filler such as carbon, metallic oxide, etc., has been dispersed.

Also referring to FIG. 9, an ion conductive transfer roller (2) is provided with an elastic layer 118 which contains ion conductive substance(s). For example, there are an ion conductive roller, the elastic layer itself of which is formed of ion conductive substance such as urethane, and an ion conductive roller, in the elastic layer of which surfactant has been dispersed.

The electrical conductivity of an electrically conductive roller of the electron conductive type comes from the electrically conductive filler dispersed in the elastic layer of the roller as described above. Therefore, it has the following problem. That is, when manufacturing an electron conductive roller, its elastic layer becomes uneven in electrical resistance due to the deformation or the like of the elastic layer which occurs as its metallic core is pressed into the elastic layer. Therefore, it is rather difficult to manufacture an electron conductive roller which is uniform in electrical conductivity. This problem is difficult to eliminate, and limits the usage of an electrically conductive roller of the electron conductive type as a charge roller or transfer roller for an image forming apparatus. If the unevenness in electrical resistance of the elastic layer of an electrically conductive roller is substantial, the roller becomes uneven in the amount of the electrical current which flows through the roller, in terms of the lengthwise direction of the roller as well as the rotational direction of the roller, causing some areas of the photosensitive drum to be overcharged, whereas other areas are undercharged. Further, sometimes, the electrical current is concentrated to the areas of minuscule size, of the peripheral surface of the photosensitive drum, by the electrical discharge caused by the bias applied to the roller. Such concentration of electrical current leaves traces of electrical discharge, which sometimes results in the formation of an inferior image.

In comparison, the problem that electrical discharge concentrates to minuscule areas of the peripheral surface of a photosensitive drum is not suffered from by a transfer roller of the ion conductive type, because of the characteristics of a transfer roller of the ion conductive type in terms of electrical conductivity. Further, the elastic layer of the transfer roller of the ion conductive type is not likely to become uneven in electrical resistance even if it is deformed. In other words, an electrically conductive roller of the ion conductive type is superior to an electrically conductive roller of the electron conductive roller type in that the former is capable of more uniformly charging an object than the latter. Therefore, the employment of the former has been increasing in the recent years.

The employment of an ion conductive roller, however, has more frequently resulted in the so-called drum contamination by seepage, that is, the problem that a photosensitive drum is contaminated by the seepage from electrically conductive rollers. This problem is thought to occur because the addition of ion conductive substances enhances the seepage and/or the rubbery substances preferable as the material for an ion conductive roller tend to allow the seepage. Thus, as an ion conductive roller is placed in contact with a moving object, the seepage from the roller formed film of the seepage on the surface of the moving object, adversely affecting the condition under which the moving object is charged. For example, when the object with which an ion conductive roller is placed in contact is a photosensitive drum, the seepage from the ion conductive roller contaminates the peripheral surface of the photosensitive drum, changing thereby the surface properties of the photosensitive drum. As a result, it becomes impossible to form an image of good quality. This is the problem from which an ion conductive roller in accordance with the prior art has been suffering.

SUMMARY OF THE INVENTION

An object of the present invention is to prevent the ingredients of an ion conductive roller from seeping out of the roller.

Another object of the present invention is to provide an image forming apparatus employing an ion conductive roller from which the ingredients thereof do not seep out.

Another object of the present invention is to provide an image forming apparatus comprising a movable member, and a roller which is placed in contact with said movable member as necessary, or always kept in contact with said movable member, said roller comprising an elastic layer to be placed in contact with said movable member, and said elastic layer being ion conductive, no less than 20° and no more than 50° in hardness (hardness is measured while by applying 500 g of weight on a 4.0 mm thick piece of elastic layer cut from roller, and expressed in Asker-C scale), and no less than 65 in the "hardness/specific gravity ($g/cm^3$)" ratio.

Another object of the present invention is to provide a roller, the elastic surface layer of which is ion conductive, no less than 20° and no more than 50° in hardness, the hardness and specific gravity ($g/cm^3$) of which satisfies the following inequality: hardness/specific gravity $\geqq 65$ (hardness is measured while applying 500 g of weight on a 4.0 mm thick piece of elastic layer cut from roller, and expressed in Asker-C scale).

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings.

Embodiment 1

Referring to FIGS. 1–6, the first embodiment of the present invention will be described.

This embodiment is characterized in that an ion conductive roller is used as a transfer roller.

[Image Forming Apparatus]

First, the image forming apparatus in this embodiment will be roughly described with reference to FIG. 2, which is a schematic sectional view of the image forming apparatus in this embodiment, showing the general structure thereof.

Figure 2:
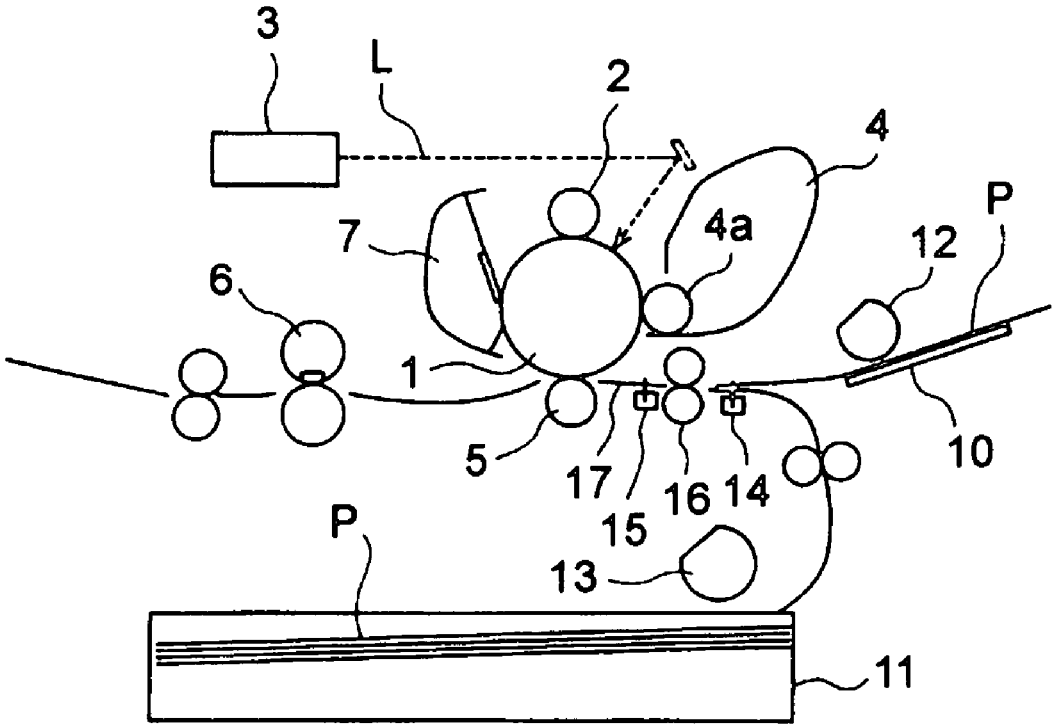
FIG. 2 is a schematic sectional view of an image forming apparatus with which the ion conductive rollers in the first to fifth embodiments of the present invention are used.

Referring to FIG. 2, in the adjacencies of the peripheral surface of a photosensitive drum 1 as an image bearing moving object, a charge roller 2, an exposing apparatus (laser scanner) 3, a developing apparatus 4, a transfer roller 5, a fixing apparatus 6, and a cleaning apparatus 7 are disposed in a manner to surround the photosensitive drum 1.

The photosensitive drum 1 is 24 mm in diameter, and comprises a cylindrical substrate formed of aluminum, nickel, or the like, and a layer of photosensitive substance, such as amorphous silicon, coated on the peripheral surface of the cylindrical substrate. It is rotationally driven (moved) at a predetermined process speed.

The charge roller 2 is kept pressed on the photosensitive drum 2 with the application of a predetermined amount of pressure so that the peripheral surface of the charge roller 2 is kept in contact with the peripheral surface of the photosensitive drum 1. Thus, the charge roller 2 is rotated by the rotation of the photosensitive drum 1. As a predetermined amount of charge bias is applied to the charge roller 2 from a charge bias power source (unshown) while the charge roller 2 is rotated in contact with the photosensitive drum 1, the photosensitive drum 1 is charged to predetermined polarity and potential level.

The exposing apparatus 3 forms an electrostatic latent image on the photosensitive drum 1 by exposing the charged photosensitive drum 1 to a beam of laser light L, which the exposing apparatus 3 emits in accordance with the image formation data inputted into the exposing apparatus 3.

The developing apparatus 4 in this embodiment is of a reversal development type. It has a development sleeve 4*a*, to which development bias is applied from a development bias power source (unshown).

The transfer roller 5 as a contact transferring means comprises a metallic core, and a spongy elastic layer formed on the peripheral surface of the metallic core. To the transfer roller 5, transfer bias is applied from a transfer bias power source (unshown). The details of the structure of the transfer roller 5 will be described later.

[Image Formation Method]

Next, the image forming operation of the above described image forming apparatus will be described.

During image formation, the photosensitive drum 1 is rotationally driven at a predetermined process speed by a driving means (unshown). While the photosensitive drum 1 is rotationally driven, its peripheral surface is charged by applying charge bias to the charge roller 2 from the charge bias power source (unshown).

The charge peripheral surface of the photosensitive drum 1 is exposed to the scanning beam of laser light L projected while being turned on or off in accordance with image formation data. As a result, an electrostatic latent image is formed on the peripheral surface of the photosensitive drum 1.

The electrostatic latent image is developed by the developing apparatus 4; it is turned into a toner image, that is, a visible image.

Meanwhile, a single or a plurality of transfer mediums P, such as a piece of recording paper, as movable objects are fed one by one by a sheet feeding roller 12 or 13 into the main assembly of the image forming apparatus from a manual feed tray 10 or a cassette 11, respectively. After being fed into the main assembly and having come into contact with a pair of registration rollers 16 by the leading edge, the transfer medium P is kept on standby by the registration roller 16, with the leading edge remaining in contact with the registration rollers 16, until it is detected by a pre-feed sensor 14 that the temperature of the fixing apparatus has reached the fixation temperature. As the temperature of the fixing apparatus reaches the fixation temperature, the transfer medium P is released by the registration rollers 16 in synchronism with the formation of the toner image on the peripheral surface of the photosensitive drum 1, and is delivered to the transfer nip (transfer station), the nipping portion formed between the photosensitive drum 1 and transfer roller 5, while being guided by a pre-transfer guide 17. The transfer roller 5 is being supplied with the bias from the unshown power source. The transfer roller 5 is kept pressed on the photosensitive drum 1 by the application of pressure equivalent to 500 g of weight. The transfer of the toner image onto the transfer medium P is caused by charging the transfer medium P by the transfer roller 5.

While the transfer medium P is moved through the transfer nip, the toner image on the peripheral surface of the photosensitive drum 1 is transferred onto the transfer medium P. After the transfer of the toner image onto the transfer medium P, the transfer medium P is conveyed to the fixing apparatus 6. In the fixing apparatus 6, the transfer medium P and the toner image thereon are subjected to heat and pressure in the transfer nip of the fixing apparatus 6. As a result, the toner image is permanently fixed to the transfer medium P. Then, the transfer medium P is discharged from the main assembly of the image forming apparatus.

Meanwhile, the transfer residual toner particles, that is, the toner particles remaining on the peripheral surface of the photosensitive drum 1 after the toner image transfer, are removed from the peripheral surface of the photosensitive drum 1 by the cleaning apparatus 7.

[Ion Conductive Roller]

Next, the transfer roller 5, which is an ion conductive roller, will be described.

Figure 1:
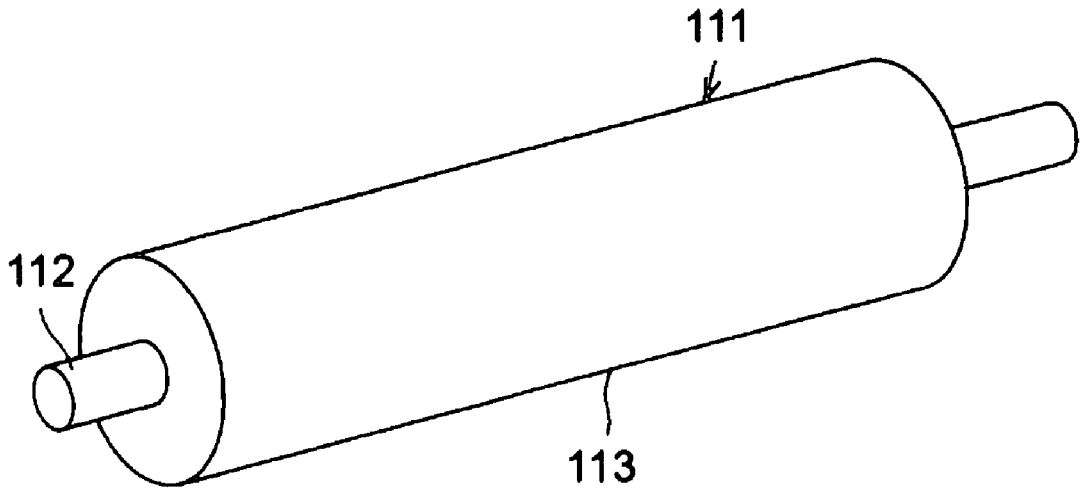
FIG. 1 is a perspective view of an ion conductive roller similar to the ion conductive rollers in the first to seventh embodiments of the present invention.
Figure 3:
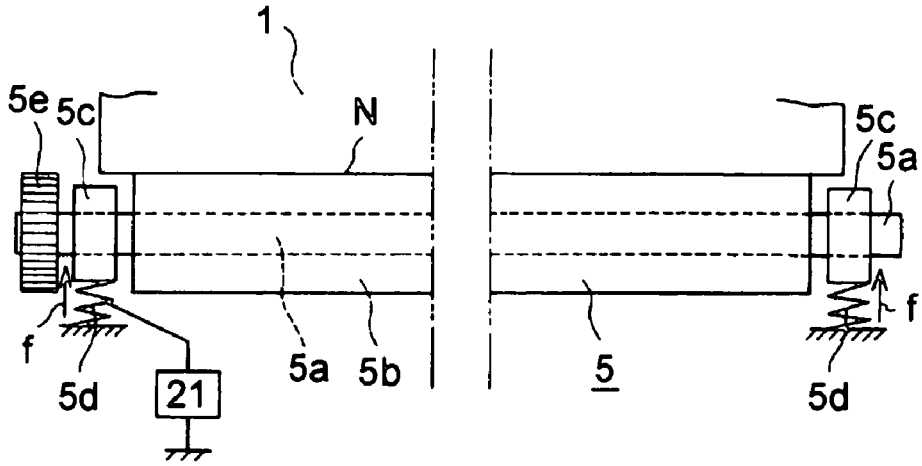
FIG. 3 is a schematic sectional view of the transfer roller in the first embodiment of the present invention, parallel to the axial direction of the roller, showing only the lengthwise ends thereof.
Figure 4:
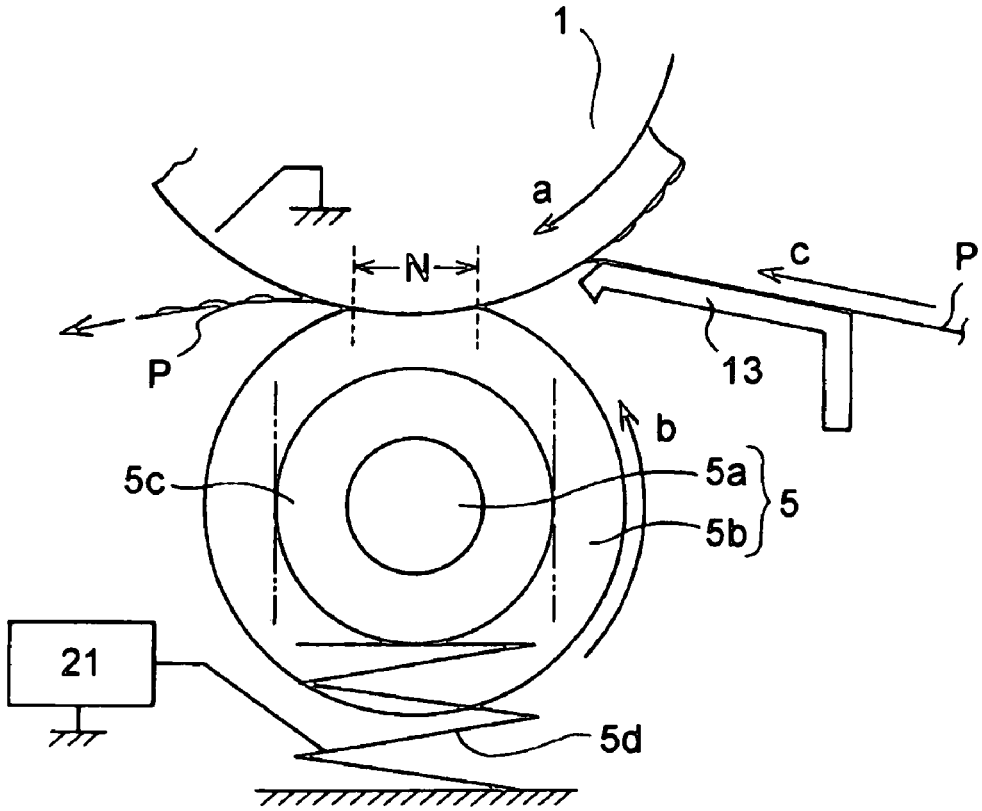
FIG. 4 is a schematic cross section of one of the lengthwise end portions of the transfer roller in the first embodiment of the present invention.

The transfer roller 5 looks like the roller, shown in FIG. 1 which is a perspective view of the ion conductive roller 111 in accordance with the present invention (ion conductive rollers in the following embodiments also look roughly the same). It comprises an electrically conductive metallic core 112, and an elastic cylindrical layer 113 fitted around the peripheral surface of the metallic core 112. The elastic layer is given electrical conductivity. In this embodiment of the present invention, the elastic layer 113 is ion conductive, being therefore less nonuniform in terms of electrical resistance. Therefore, it is superior to an electron conductive roller in that the former is capable of more uniformly charging an object than the latter. Referring to FIG. 3, the metallic core 5*a* of the transfer roller 5 is formed of iron, stainless steel, aluminum, or the like. The elastic layer 5*b* of the transfer roller 5 is in the form of a hollow cylinder, and is formed of a spongy substance formed of EPDM (ethylene propylene rubber), NBR (acrylonitrile butadiene rubber), ECO (epichlorohydrin-ethylene oxide rubber), or the like. As the material for the elastic layer 5*b* in this embodiment, an elastic substance, the hardness of which measured while it is under 500 g of weight is in the range of 20°–50° on the Asker-C hardness scale (Type C Rubber Hardness Gauge made by Koobunshi Keiki Co.), and the electrical resistance of which is in the range of $10^6$–$10^{10}$ Ω, is used.

Incidentally, the hardness value of the elastic layer of each of the electrically conductive rollers in all the embodiments of the present invention was measured with the use of a Rubber Hardness Gauge C (product of Koobunshi Keiki Co.) while the elastic layer was kept under 500 g of weight (inclusive of weight of measuring instrument itself), and is expressed on the Asker-C scale. More specifically, a piece of the elastic layer portion of the ion conductive roller was cut out so that the thickness of the piece became 4.0 mm. Then, the piece was placed on a plate made of steel or the like, and the hardness of the piece was measured. It was assured that when cutting out a piece of the elastic layer to measure the hardness of the elastic layer, the area of the cut piece within 10 mm radius from the point of the cut piece with which the probe is placed in contact, became 4.0 mm in thickness. In the case of a roller, the elastic layer of which is 4.0 mm in thickness, the value obtained by measuring the hardness of the elastic layer of this roller without cutting a piece out of the elastic layer sometimes is the same as the value obtained by measuring the hardness of a piece of the elastic layer cut out of the elastic layer of the roller. In such a case, the hardness of the elastic layer of the roller may be directly measured after confirming the relationship between the value obtained by directly measuring the hardness of the elastic layer of the roller, that is, without cutting out a piece of the elastic layer. However, when measuring the hardness of the elastic layer of a roller formed by pressing the metallic core portion of the roller into the elastic layer portion of the roller, special attention should be paid for the following reason. That is, after the insertion of the metallic core into the elastic layer portion, the elastic layer portion is in the compressed condition. Therefore, in the case of some rollers, the value obtained by measuring the hardness of the elastic layer while the elastic layer is on the metallic core are different from the value obtained by measuring the test piece cut out of the elastic layer on the metallic core. When it is impossible to obtain a test piece having the thickness of 4.0 mm, the value obtained by measuring the hardness of the combination of two 2.0 mm thick test pieces placed in layers may be substituted for the value of the hardness of a 4.0 mm thick test piece, as long as the elastic layer is uniform in physical properties in terms of the thickness direction of the elastic layer. It has been confirmed by the inventors of the present invention that such substitution did not substantially affect the results of the measurements.

A simplified version of the method for forming the elastic layer 5*b* is as follows. First, such chemicals as vulcanizing agent, filler, foaming agent, vulcanization accelerator, foaming accelerator, etc., are added to such rubber as EPDM, NBR, ECO, etc. Then, the mixture is kneaded. Then, the kneaded mixture is extruded to form the cylindrical elastic layer portion of a roller. The vulcanization accelerator is preferably thiuram type vulcanization accelerator, since then a great amount of sulfer is supplied. Then, the formed cylindrical elastic layer portion of a roller is subjected to first and second curing processes. Then, a metallic core is pressed into the center hole of the cured elastic layer portion of a roller. Lastly, the surface of the roller is polished to complete a roller having a predetermined shape and measurements.

Referring to FIG. 3, the transfer roller 5 is disposed in parallel to the photosensitive drum 1, and is rotatably supported by a pair of bearings 5*c* by the lengthwise end portions, one for one, of the metallic core 5*a* of the roller 5. The transfer roller 5 is kept pressured by a total pressure equivalent to 1.0 kg of weight generated by a pair of compression springs 5*d*, upon the photosensitive drum 1 so that a transfer nip N is formed between the peripheral surfaces of the elastic layer 5*b* and photosensitive drum 1.

The gear 5*e* in FIG. 3 is fixed to one of the lengthwise ends of the metallic core 5*a* of the transfer roller 5, and is meshed with an unshown driving gear. Thus, rotational force is transmitted from the unshown driving gear to the gear 5*e*, rotating thereby the transfer roller 5 in the counterclockwise direction indicated by an arrow mark b in FIG. 4 at a predetermined peripheral speed. On the other hand, the photosensitive drum 1 is rotationally driven in the clockwise direction indicated by an arrow mark a shown in FIG. 4 at a predetermined peripheral velocity. The transfer medium P is conveyed in the direction indicated by an arrow mark c in FIG. 4, and is delivered to the transfer nip N formed by the photosensitive drum 1 and transfer roller 5, while being guided by the pre-transfer guide 17.

To the transfer roller 5, transfer bias is applied from a transfer bias application power source 21 through the pair of compression springs 5*d*, pair of bearings 5*c*, and metallic core 5*a*, which are electrically conductive.

While the transfer medium P having been delivered to the transfer nip N with a predetermined control timing is conveyed through the transfer nip N while remaining nipped by the photosensitive drum 1 and transfer roller 5, the predetermined voltage opposite in polarity to the toner image on the photosensitive drum 1 is applied to the transfer roller 5 from the transfer bias application power source 21. As a result, the transfer medium P is electrically charged in the transfer nip N, causing thereby the toner image on the photosensitive drum 1 to be electrostatically transferred onto the transfer medium P as if the toner image were rolled out of the photosensitive drum 1 onto the transfer medium P.

Figure 5:
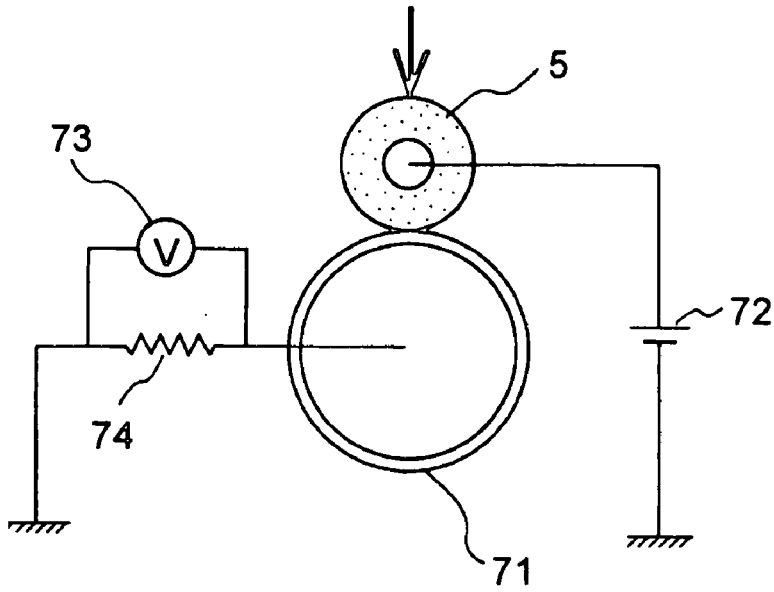
FIG. 5 is a schematic drawing showing a method for measuring the electrical resistance of an ion conductive roller in accordance with the present invention.

The method for measuring the electrical resistance of the transfer roller 5 is as follows. Referring to FIG. 5, the transfer roller 5 is placed in contact with an aluminum cylinder so that a total contact pressure of 600 g (300 g per lengthwise end) is maintained between the photosensitive drum 1 and transfer roller 5. Then, the maximum and minimum amounts of the voltage between the two ends of a resistor 75 are read with the use of a voltmeter 73 when a certain amount of voltage (for example, +2.0 kV) is applied while the transfer roller 5 is rotated. Then, the average value of the electrical current which flows through the circuit is calculated from the voltage values. Then, from the average current value, the electrical resistance of the transfer roller 5 is calculated (measurement conditions: 20° C. in temperature and 60% in relative humidity).

The transfer roller 5 in this embodiment is a transfer roller having a spongy elastic layer, the hardness of which is in the range of 20°–50°, which is the desirable range for the transfer roller 5 to be used as a transfer roller for an image forming apparatus. It is formed of the material concocted so that the value of "hardness/specific gravity" ratio of the entirety of the elastic layer 5*b* of the transfer roller 5 becomes no less than 65, without hardening the surface thereof, that is, without exposing it to ultraviolet rays or the like to change the elastic layer in cross-linking density.

The studies made by the inventors of the present invention revealed that the specific gravity and hardness of the elastic layer of a transfer roller, and the ratio of the hardness to the specific gravity, seriously affect the seepage from the transfer roller, and also that the greater the amount of the seepage, the greater the possibility that the photosensitive drum will be contaminated. Thus, in order to prevent the photosensitive drum contamination traceable to the seepage from a transfer roller, the inventors of the present invention carried out various experiments in which the choice of material for the elastic layer of a transfer roller, combination among the materials, manufacturing conditions, etc., were varied. The experiments revealed that as long as a transfer roller was manufactured so that its elastic layer 5*b* became no less than 50 in "hardness/specific gravity" ratio, the problem that the photosensitive drum 1 is contaminated by a transfer roller 5 could be prevented.

The experiment also revealed that as long as a transfer roller was manufactured under appropriate conditions, by choosing and combining the materials for a transfer roller 5 so that the elastic layer 5*b* of a transfer roller 5 became no less than 65 in "hardness/specific gravity" ratio, the amount by which the peripheral surface of the transfer roller was frictionally worn was smaller, and therefore, the roller remained stable in performance.

[Seepage]

[Results of Experiments]

(Amount of Sulfur)

A plurality of ion conductive rollers comprising a metallic core with an external diameter of 6 mm, and a spongy elastic layer formed of rubbery substance, more specifically, blend of NBR and ECO, were employed. They were 14 mm in external diameter. The ion conductive rollers were made different in the hardness and specific gravity of the elastic layer by varying them in ingredients, vulcanization condition, etc., although the hardness was kept within the range of 20°–50°. More specifically, the amount by which sulfur was added, choice of filler, amount by which filler was added, and foaming condition, were varied to search for a desirable amount by which sulfur was to be added, desirable choice(s) of filler, a desirable amount by which filler was added, and a desirable foaming condition, for manufacturing a desirable ion conductive roller as a transfer roller.

First, the ratio by which sulfur was added to the rubber was varied to grasp the relationship between the amount of the sulfur in the elastic layer and the amount of seepage (contamination). Generally, the greater the amount by which sulfur was added to the rubber, the higher the resultant cross-linking density, in other words, the harder the rubber became. The results of the experiment in which the relationship between the amount by which sulfur was added to rubber and the extent of the contamination of the photosensitive drum 1 was examined by using a plurality of transfer rollers different in the amount of the sulfur in the elastic layer thereof, being therefore different in the hardness of the elastic layer (rubber), are given in Table 1.

The ratio at which sulfur was added to the rubber was varied in the range of 0.5 phr to 2.0 phr (ratio in weight of sulfur to rubber).

The plurality of transfer rollers comprised an aluminum core with an external diameter of 6 mm, and a cylindrical spongy elastic layer formed of the blend of NBR and ECO (blended at ratio of 8:2) and fitted around the aluminum core so that the overall external diameter of the transfer roller became 14 mm. They were made different in the ratio of the sulfur in the elastic layer, being therefore different in the hardness of the elastic layer. Otherwise, they were made the same in the other factors such as contents of the ingredients other than sulfur, conditions under which they were manufactured, etc. roller was deduced from the extent of the contamination of a photosensitive drum by the seepage from the transfer roller.

The photosensitive drum and transfer roller were kept pressed against each other with the application of pressure equivalent to 1,000 g of weight, and left unattended for one week in an environment that was 40° C. in temperature and 95% in humidity. After one week, the transfer rollers were separated from photosensitive drums 1, and the area of each photosensitive drum, which was in contact with the photosensitive drum 1, was observed with the use of a microscope. In Table 1, "G" means that the photosensitive drum was contaminated, but the contamination of the photosensitive drum 1 was not serious enough to suggest that the transfer roller should not be used for image formation; "E" means that the photosensitive drum 1 was in excellent condition; and "NG" means that the photosensitive drum 1 was contaminated seriously enough to suggest that the usage of the photosensitive drum would result in the formation of a conspicuously defective image.

TABLE 1

| | S CONTENT | | | |
|---|---|---|---|---|
| | 0.5 phr | 1.0 phr | 1.5 phr | 2.0 phr |
| CONTAMINATION | NG | G | E | E |

E: excellent,
G: no problem in practical terms,
NG: contamination is serious enough to create problems.

The correlation between the method used for testing the transfer rollers in the above described experiment and the length of the actual service life of a transfer roller had been established. In other words, if a given roller was evaluated as E or G in the above described test, it means that the roller does not deteriorate in terms of image quality when used as the transfer roller of an image forming apparatus. On the other hand, if a given transfer roller was evaluated as NG, it means that the roller gradually deteriorates in terms of image quality while it is used as the transfer roller of an image forming apparatus.

It is evident from Table 1 that the greater the sulfur content of the elastic layer of a transfer roller, in other words, the higher the cross-linking density of the transfer roller, the harder the elastic layer of the transfer roller, and the smaller the amount by which the elastic layer ingredients with a lower molecular weight seep out of the elastic layer and contaminate a photosensitive drum.

(Amount of Filler)

Next, the abovementioned filler will be described. The filler is added to the rubber for the purpose of improving the rubber in strength, processability, etc., making it easier for additives to be dispersed in the rubber, increasing the rubber in apparent volume, or the like purposes. For example, inorganic substances such as carbon, calcium carbonate, or the like, are used as the filler.

It has been revealed by the studies made by the inventor of the present invention that the smaller the amount of the inorganic filler in the elastic layer (rubber layer) of a transfer roller, the smaller the amount by which the elastic layer ingredients, such as the additives, seep out of the elastic layer and contaminate a photosensitive drum.

The results of the experiment in which a plurality of transfer rollers different in the amount of the filler in the elastic layer, were used to examine the relationship between the amount of the filler in the elastic layer of a transfer roller and the extent of drum contamination are given in Table 2.

Each of the plurality of transfer rollers used in the experiment comprised an aluminum core with an external diameter of 6 mm, and a cylindrical spongy elastic layer formed of the blend of NBR and ECO (blended at ratio of 8:2) and fitted around the aluminum core so that the overall external diameter of the transfer roller became 14 mm. The plurality of transfer rollers were made virtually identical in specifications and manufacturing conditions, except for the ratio of the filler in the elastic layers (rubber layers) thereof to the rubber. The filler was the half-and-half mixture of carbon black and calcium carbonate. The transfer rollers were made different in the weight ratio of the filler mixture to the rubber, within the range of 10 phr–50 phr. They were subjected to the same test as the test which yielded the results given in Table 1.

TABLE 2

| | FILLER CONTENT | | | | |
|---|---|---|---|---|---|
| | 10 phr | 20 phr | 30 phr | 40 phr | 50 phr |
| CONTAMINATION | E | E | G | NG | NG |

It is evident from the results given in Table 2 that the smaller the amount of the filler in the elastic layer of a transfer roller, the smaller the amount by which the ingredients with a low molecule weight in the elastic layer seep out and transfer onto a photosensitive drum. The filler is substantially higher in specific gravity than rubber. Therefore, the greater the amount of the filler in the elastic layer material, the higher the specific gravity of the elastic layer material.

Thus, as the means for controlling the specific gravity of the elastic layer of a transfer roller, it is effective to control the amount by which the filler is added to the material for the elastic layer. An elastic layer material which is higher in hardness and lower in specific gravity is lower in the amount of the filler therein, and therefore, is likely to be smaller in the amount of seepage. In other words, the higher the "hardness/specific gravity" ratio of the elastic layer of a transfer roller, the smaller the amount by which a photosensitive drum is contaminated by the seepage from the transfer roller.

Figure 6:
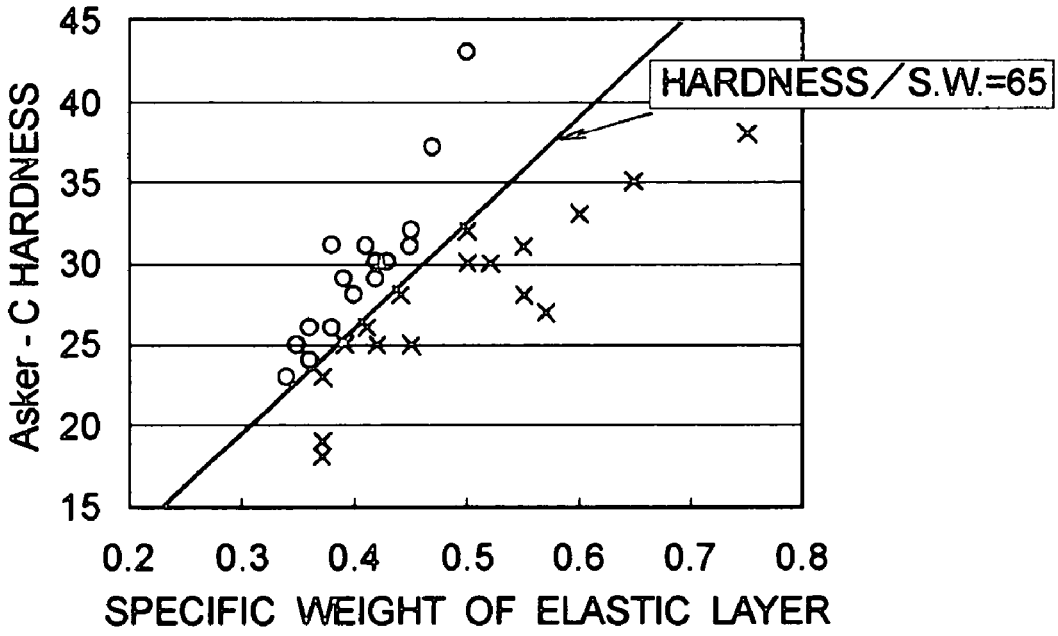
FIG. 6 is a graph showing the results of the drum contamination test carried out to find out the relationship between the "hardness/specific gravity" ratio of a transfer roller in accordance with the present invention, and the extent of the photosensitive drum contamination by the transfer roller.

FIG. 6 shows the results of the evaluation, in terms of the photosensitive drum contamination, of the transfer rollers, different in the ingredients in the elastic layers thereof and vulcanization condition, obtained by repeating the same experiment as those carried out to obtain the results given in Tables 1 and 2.

The transfer rollers used in this experiment were the same as those used in the preceding experiments. In other words, they comprised an aluminum core with an external diameter of 6 mm, and a cylindrical spongy elastic layer formed of the blend of NBR and fitted around the aluminum core. Their overall external diameters were 14 mm. The transfer rollers were made different in the hardness and specific gravity of the elastic layer by varying them in ingredients, vulcanization condition, etc., although the hardness was kept within the range of 20°–50°. The transfer rollers were evaluated using the same method as that used for evaluating the transfer rollers in the preceding experiments.

As will be evident from the graph in FIG. 6, the distribution of the symbols representing the extent of the contamination of a photosensitive drum displays certain characteristics. That is, the transfer rollers, the evaluations of which were in the top left area of the graph in FIG. 6, in other words, the transfer rollers, which were no less than 65 in the "hardness/specific gravity", ratio were acceptable in terms of the extent of the contamination of the photosensitive drum. The results given in FIG. 6 suggests that there is a correlation between the extent of the photosensitive drum contamination and the "hardness/specific gravity" ratio of the elastic layer of a transfer roller. It is possible to grasp the extent of the seepage from a transfer roller, or the extent of the photosensitive drum contamination, from the results given FIG. 6. In other words, a numerical value 65 is the threshold value of "hardness/specific gravity" ratio.

As one of the means for preventing the photosensitive drum contamination, it was proposed to expose the peripheral surface of a transfer roller to ultraviolet light or a beam of electrons, in order to prevent the seepage of the ingredients in the elastic layer of the transfer roller, by altering the surface properties of the transfer roller (Japanese Laid-open Patent Application 11-109770).

According to the description in Japanese Laid-open Patent Application 11-109770, the peripheral surface of the transfer roller is exposed to ultraviolet rays, a beam of electrons, or the like, in order to harden the surface portion of the transfer roller into a barrier layer, by triggering the cross-linking reaction in the surface portion of the transfer roller. It is assumed that the presence of the barrier layer prevents the peripheral surface of the transfer roller from reacting with the peripheral surface of a photosensitive drum, preventing thereby the ingredients of the elastic layer of the transfer roller from seeping out.

This method, however, had a problem in that as the surface layer of a transfer roller was hardened by the exposure to ultraviolet rays, the transfer roller was reduced in friction coefficient, becoming therefore slower in the speed at which the transfer roller conveyed transfer medium than a transfer roller which was not subject to ultraviolet rays. Further, as the surface layer hardened by the exposure to ultraviolet rays was shaved, an unhardened layer was exposed, allowing thereby the ingredients of the elastic layer to seep out. Therefore, a transfer roller, the surface layer of which was hardened by the exposure to ultraviolet rays or the like had to be replaced before the shaving of its surface layer became serious.

Further, exposing a transfer roller to ultraviolet rays added to the number of the transfer roller manufacturing steps. Therefore, this solution proposed in Japanese Laid-open Patent Application 11-109770 was disadvantageous in terms of manufacturing time and equipment.

Thus, the primary object of the present invention is provide an electrically conductive roller, the ingredients of the elastic layer of which do not seep out; the peripheral surface of which does not change in friction coefficient regardless of the frictional wear resulting from usage; and the surface layer of which does not constitutes a barrier layer.

[Theoretical Explanation of Contamination Prevention Mechanism]

An electrically conductive roller in accordance with the present invention is higher in the cross-linking density of the spongy elastic (rubber) layer than an electrically conductive roller in accordance with the prior art. It is characterized in that the entirety of the spongy elastic (rubber) layer is hardened. Therefore, the surface portion of its elastic layer does not need to be hardened into a barrier layer in order to prevent the ingredients of its spongy surface layer from seeping out; it does not need to be exposed to ultraviolet rays or the like to increase it in cross-linking density to harden it. Further, in the case of the electrically conductive roller in accordance with the present invention, the capability of preventing the seepage is not limited to the surface layer of the roller. In other words, the entirety of its elastic layer is capable of preventing the seepage. Therefore, even after the surface layer becomes frictionally shaved due to usage, the ingredients in its elastic layer do not seep out from the fresh surface formed by the frictional shaving. The following is the theoretical explanation by the inventors of the present invention, regarding the mechanism by which the seepage is prevented.

If a spongy elastic layer is higher in "hardness/specific gravity" ratio, it means that the wall portions, that is, the actual rubber portions, of the spongy elastic layer are strong. This means, from the standpoint of physics, that the spongy elastic layer is smaller in the area by which it actually contacts an object. In other words, even if a spongy elastic layer higher in "hardness/specific gravity" ratio, and a spongy elastic layer lower in "hardness/specific gravity" ratio are the same in the macroscopic size, that is, apparent size, of the contact area, or the nip, between an elastic layer and an object, the former is microscopically, that is, actually, smaller in the contact area. In other words, the former is smaller in terms of its contact with an object than the latter, and therefore, smaller in the amount of the chemical effects upon an object with which it comes into contact.

From the standpoint of chemistry, being larger in "hardness/specific gravity" ratio means being higher in cross-linking density. Being higher in cross-linking density means being more effective to keep contained the ingredients capable of seeping out. Moreover, being larger in "hardness/specific gravity" ratio means being smaller in the amount of the ingredients with a low molecular weight capable of seeping out in the first place. Further, the higher the cross-linking density, the stronger the tensile strength, and therefore, the smaller in the amount by which it is shaved. Therefore, being larger in "hardness/specific gravity" ratio is effective to prevent such contamination that results from the adhesion of minuscule shavings.

Because of the above described reasons, the inventors of the present invention thought that the contamination of a photosensitive drum could be prevented by controlling the "hardness/specific gravity" ratio of a transfer roller.

[Conveyance of Transfer Medium]

The transfer roller in this embodiment does not contaminate a photosensitive drum even though the peripheral surface of its elastic layer is not hardened by a surface hardening process in which the peripheral surface of the elastic layer is irradiated with ultraviolet rays or the like to be changed in cross-linking density. Thus, neither does it contaminate a photosensitive drum, nor change in transfer medium conveyance efficiency, even if the interior of its elastic layer is exposed as the elastic layer is frictionally worn due to usage. Further, compared to a transfer roller which does not satisfy the inequality: hardness/specific gravity ≧65, the transfer roller in this embodiment is smaller, in the first place, in the amount by which the surface layer of its elastic layer is frictionally worn. Moreover, even among transfer rollers, the surface of which was not subjected to such a surface treatment as being irradiated with ultraviolet rays or the like, the transfer roller in this embodiment displayed superior results; it was smaller in the changes in print magnification, that is, the changes in print magnification ratio remained within the tolerable range throughout the guaranteed length of time (expected service life of an image forming apparatus).

The differences between the transfer roller in this embodiment irradiated with ultraviolet rays (which hereinafter may be referred to simply as UV), and the transfer roller in this embodiment unirradiated with ultraviolet rays, in terms of the changes in printing accuracy, which occurred as the cumulative number of transfer mediums put through the image forming apparatus increased, are shown in Table 3.

The image forming apparatus used for the experiment for testing these transfer rollers was 105 mm/sec in process speed, and was capable of outputting 15 letter size copies per minute. The guaranteed length of its service life was 50,000 copies. The amount of the pressure which was applied to keep the transfer roller upon the photosensitive drum was equivalent to 500 g of weight.

TABLE 3

| | | PRINT MAG. CHANGE | | | |
|---|---|---|---|---|---|
| | HARDNESS/ SPECIFIC WEIGHT | AFTER 10000 SHEETS | AFTER 20000 SHEETS | AFTER 50000 SHEETS | AFTER 75000 SHEETS |
| UV-TREATED | 45 | 0.50% | 0.80% | 0.10% | 0.12% |
| NOT UV-TREATED | 45 | 0.00% | −0.05% | −0.10% | −0.14% |
| | 67 | 0.00% | −0.01% | −0.03% | −0.04% |

In the case of the transfer roller irradiated with ultraviolet rays, its hardened surface layer was frictionally worn, and the unhardened inner portion of its elastic layer, which was higher in friction coefficient, was exposed. Thus, it gradually increased in transfer medium conveyance efficiency, substantially reducing in printing accuracy. In comparison, in the case of the transfer roller which was unirradiated with ultraviolet rays, but was 45 in the value of "hardness/specific gravity" ratio, the amount by which it was frictionally worn through usage was substantial. Therefore, as the cumulative number of the transfer mediums increased, the efficiency with which the transfer medium, as an object to be moved, was conveyed by the unirradiated transfer roller which was 45 in the "hardness/specific gravity" ratio, substantially reduced.

In comparison, in the case of the transfer roller unirradiated with ultraviolet rays and being 67 in "hardness/specific gravity" ratio, the amount by which it was frictionally shaved was smaller in the first place, being therefore excellent in performance.

To elucidate the aforementioned theory behind of the working mechanism of the transfer roller, an elastic layer which is no less than 65 in "hardness/specific gravity" ratio is relatively high in cross-linking density, being therefore relatively high in tear strength. Therefore, it is less likely to tear, being therefore smaller in the amount by which it is shaved.

As described above, according to this embodiment, by making the "hardness/specific gravity" ratio of the elastic layer of a transfer roller no less than 65 without subjecting the elastic layer to a surface layer hardening process of irradiating it with ultraviolet rays or the like, it is possible to provide a transfer roller which does not contaminate a photosensitive drum, and is stable in transfer medium conveyance performance, throughout its service life.

Further, in the case of the electrically conductive roller in this embodiment, the entirety, instead of the surface layer, of its spongy elastic layer is enabled to prevent the ingredients therein from seeping out. Therefore, even after the spongy elastic layer is frictionally shaved due to usage, it remains the same in surface friction coefficient. Therefore, when it is used as a transfer roller for an image forming apparatus, it remains stable in transfer medium conveyance performance; it is preferable as a transfer roller for an image forming apparatus.

Further, by polishing in advance the electrically conductive roller in this embodiment, it is possible to prevent the problem that there is a large amount of difference, in the surface properties of a transfer roller, between when the transfer roller is brand-new, and after it is substantially shaved by transfer medium.

Embodiment 2

The second embodiment is the same as the first embodiment, except that the ratio of the sulfur and total amount of filler in the transfer roller in the second embodiment is no less than 1.0 phr, and no more than 30 phr, respectively. The other specifications of the transfer roller in the second embodiment are the same as those in the first embodiment, and therefore, will not be described.

As will be evident from Tables 1 and 2, the greater the amount of sulfur in the elastic layer of a transfer roller, the smaller the amount of the seepage therefrom. Further, the smaller the amount of the filler in the elastic layer of a transfer roller, the smaller the amount of the seepage therefrom.

In this embodiment, sulfur is added by no less than 1.0 phr, and the total amount of the filler is kept below 30 phr. Therefore, the transfer roller 5 in this embodiment is highly effective in terms of solving the problem of photosensitive drum contamination.

The results of the experiment carried out to test the transfer rollers formed in accordance with the above described conditions regarding the sulfur and the total amount of filler, in order to confirm the effects of the sulfur contents and total amount of filler in the elastic layer of a transfer roller upon the drum contamination are given in Table 4.

The transfer rollers used for the experiment comprised an aluminum core with an external diameter of 6 mm, and a spongy elastic layer formed of the blend of NBR and ECO rubbers, on the peripheral surface of the aluminum core so that the overall diameter of the transfer roller becomes 14 mm. The test conditions are the same as those under which the results given in Table 1 were obtained.

TABLE 4

| | EXAMPLE 1 | EXAMPLE 2 | EXAMPLE 3 |
|---|---|---|---|
| S CONTENT | 1.0 phr | 1.5 phr | 2.0 phr |
| CB (Filler) CONTENT | 10 phr | 10 phr | 15 phr |
| $CaCO_3$ (Filler) CONTENT | 20 phr | 10 phr | 0 phr |
| TRANSFER ROLLER HARDNESS (Asker-C) | 33 | 32 | 31 |
| SPECIFIC WEIGHT OF ELASTIC LAYER | 0.5 | 0.45 | 0.38 |
| HARDNESS/ SPECIFIC WEIGHT | 66 | 71 | 82 |
| DRUM CONTAMINATION | G | E | E |

E: excellent
G: no problem in practical terms
NG: contamination is serious enough to create problems As will be evident from Table 4, when sulfur was added by no less than 1.0 phr while the total amount of filler was kept at no more than 30 phr, the contamination of a photosensitive drum did not occur even when the elastic layers of the transfer rollers were not irradiated with ultraviolet rays or the like.

Embodiment 3

The third embodiment of the present invention is virtually the same as the first and second embodiments, except that only azodicarbonamide (which hereinafter will be abbreviated as ADCA) is used as the foaming agent for forming the spongy elastic layer of the transfer roller.

Azodicarbonamide as foaming agent is very high in foaming ratio, and therefore is needed by only a small amount to foam the rubber as the material for the elastic layer of a transfer roller. Therefore, azodicarbonamide is capable of providing a transfer roller, the material for the elastic layer of which is high in cross-linking density, being therefore higher in hardness, and yet, the overall hardness of which is in the desirable range for the transfer roller for an image forming apparatus, more specifically, the range of 20°–50°.

Incidentally, it has been revealed that many of the additives to be added to the material for the elastic layer of a transfer roller are the sources of the seepage. In particular, the chemical compounds resulting from the decomposition of foaming agent are likely to seep, being therefore likely to contaminate a photosensitive drum. However, the chemical compounds resulting from the decomposition of azodicarbonamide are low in reactivity. Therefore, a spongy elastic (rubber) layer formed with the use of azodicarbonamide as foaming agent is much smaller in the amount of the photosensitive drum contamination than a spongy elastic (rubber) layer formed with the use of foaming agent other than azodicarbonamide, for example, OBSH, etc.

The results of the drum contamination experiment carried out to test the transfer rollers, the elastic layers of which were formed with the use of azodicarbonamide as foaming agent, are given in Table 5.

The transfer rollers used for the experiment comprised an aluminum core with an external diameter of 6 mm, and a spongy elastic layer formed of the blend of NBR and ECO rubbers, on the peripheral surface of the aluminum core so that the overall diameter of the transfer roller became 14 mm. As the foaming agent, VINIHOORU AC (commercial name of azodicarbonamide-series compound manufactured by EIWAKASEI, Co.) was used. The test conditions were the same as those under which the results given in Table 1 were obtained.

TABLE 5

| | EXAMPLE 4 | EXAMPLE 5 |
|---|---|---|
| FORM MATERIAL CONTENT | ADCA 4 phr | ADCA 4 phr |
| S CONTENT | 1.5 phr | 2.0 phr |
| CB (Filler) CONTENT | 10 phr | 15 phr |
| $CaCO_3$ (Filler) CONTENT | 10 phr | 0 phr |
| TRANSFER ROLLER HARDNESS (Asker-C) | 32 | 31 |
| SPECIFIC WEIGHT OF ELASTIC LAYER | 0.45 | 0.38 |
| HARDNESS/ SPECIFIC WEIGHT | 71 | 82 |
| DRUM CONTAMINATION | E | E |

E: excellent
G: no problem in practical terms
NG: contamination is serious enough to create problems As will be evident from Table 5, by using azocarbonamide-series compound as foaming agent, it was possible to produce transfer rollers which did not contaminate a photosensitive drum.

As described above, in this embodiment of the present invention, the solid portions of the spongy elastic layer of the transfer roller are increased in hardness by increasing them in cross-linking density. Therefore, the ingredients of the spongy elastic layer can be prevented from seeping out of the elastic layer, without turning the surface portion of the elastic layer into a barrier layer by irradiating it with ultraviolet rays or the like.

Next, the usage of the above described ion conductive rollers in an image forming apparatus, different from that in the preceding embodiments, will be described.

Embodiment 4

The "hardness/specific gravity" ratio of the ion conductive rollers in this embodiment were no less than 65 as were those in the first to third embodiments. They were irradiated with ultraviolet rays, and tested using the image forming apparatus used to test the transfer rollers in the first embodiment. These rollers in this embodiment did not suffer from the seepage problem even before they were irradiated with ultraviolet rays. Thus, they were excellent as far as the seepage was concerned. Their performance in terms of transfer medium conveyance were as shown in Table 6. That is, among the irradiated transfer rollers transfer rollers, those which were no less than 65 in the "hardness/specific gravity" ratio were better in that they were smaller in the change in print magnification. Further, they were better than the unirradiated transfer rollers, the "hardness/specific gravity" ratio of which was 45. These results seem to have occurred for the following reason. That is, also in the case of the ion conductive rollers in this embodiment, as the surface portion of the roller irradiated with ultraviolet rays was shaved, it changed in friction coefficient, and therefore, changed in the transfer medium conveyance performance, as did the transfer roller in the first embodiment. In the case of the ion conductive roller in this embodiment, however, the roller itself was difficult to shave in the first place. Therefore, the changes in the friction coefficient which occurred as the portion having been hardened by being irradiated with ultraviolet rays was shaved were offset by the changes in the overall diameter of the roller, minimizing thereby the changes in the print magnification resulting from the changes in the performance of the roller in terms of transfer medium conveyance.

TABLE 6

| | | PRINT MAG. CHANGE | | | |
|---|---|---|---|---|---|
| | HARD-NESS/ SPECIFIC WEIGHT | AFTER 10000 SHEETS | AFTER 20000 SHEETS | AFTER 50000 SHEETS | AFTER 75000 SHEETS |
| UV-TREATED | 45 | 0.50% | 0.80% | 0.10% | 0.12% |
| | 67 | 0.04% | 0.07% | 0.03% | 0.01% |
| NOT UV-TREATED | 45 | 0.00% | −0.05% | −0.10% | −0.14% |
| | 67 | 0.00% | −0.01% | −0.03% | −0.04% |

In other words, from the standpoint of the stability of the transfer medium conveyance performance, the ion conductive rollers in this embodiment were not as good as the ion conductive roller in the first embodiment, but were better than an ion conductive roller in accordance with the prior art.

Embodiment 5

In this embodiment, the ion conductive rollers which are the same in specification as those in the preceding embodiments, and are manufactured under the same conditions as those in the preceding embodiments, are used as charge rollers. Their electrical resistances measured in the normal environment (20° C. temperature and 60% in humidity) after they were kept unattended for three days in the normal environment, were $10^6$ Ω. The resistance was measured with the use of an apparatus shown in FIG. 5 for measuring the electrical resistance of a roller; the charge roller 2 was placed where the transfer roller 5 is in FIG. 5. To the aluminum cylinder, 500 V was applied. Incidentally, when the ion conductive roller in this embodiment is used as the charge roller for an image forming apparatus, the combination of a DC voltage of −600 V and an AC voltage which is 1,700 V in peak-to-peak voltage and is 1,000 Hz in frequency, is applied as charge bias to the charge roller, during image formation. The charge roller 2 is kept pressed on the photosensitive drum 1 with the application of a total pressure of 500 g.

The transfer rollers used for the experiment comprised an aluminum core with an external diameter of 6 mm, and a spongy elastic layer formed of the blend of NBR and ECO rubbers, on the peripheral surface of the aluminum core so that the overall diameter of the transfer roller became 14 mm. The charge roller 2 was kept in contact with the photosensitive drum 1 as an image bearing member, as were the transfer rollers in the preceding embodiments, so that the photosensitive drum 1 became charged as electrical discharge occurred between the charge roller 2 and photosensitive drum 1, in the area which was slightly away from the contact area between the charge roller 2 and photosensitive drum 1, and in which there was a predetermined amount of gap between the charge roller 2 and photosensitive drum 1. The charge roller 2 was rotationally supported in contact with the photosensitive drum 1 so that it would be rotated by the rotation of the photosensitive drum 1.

The charge roller 2 remained in contact with the photosensitive drum 1 not only while it was rotated but also while it was kept stationary. If an ion conductive roller other than an ion conductive roller in accordance with the present invention is used as the charge roller of an image forming apparatus, the photosensitive drum 1 is sometimes contaminated by the seepage from the charge roller, changing thereby the condition under which the photosensitive drum 1 is charged, which in turn reduces the performance of the image forming apparatus. This symptom is particularly serious after the image forming apparatus is left unused for a long time, because while the image forming apparatus is left unused, a specific area of the charge roller 2 remains in contact with a specific area of the photosensitive drum 1 for a long time.

In this embodiment, the ion conductive roller in accordance with the present invention is used as the charge roller 2. Therefore, the above described photosensitive drum contamination does not occur. Therefore, the cumulative length of time the photosensitive drum 1 can be uniformly charged to the normal potential level is much longer. Therefore, the cumulative length of time the image forming apparatus remains normal in performance is longer.

Embodiment 6

Figure 7:
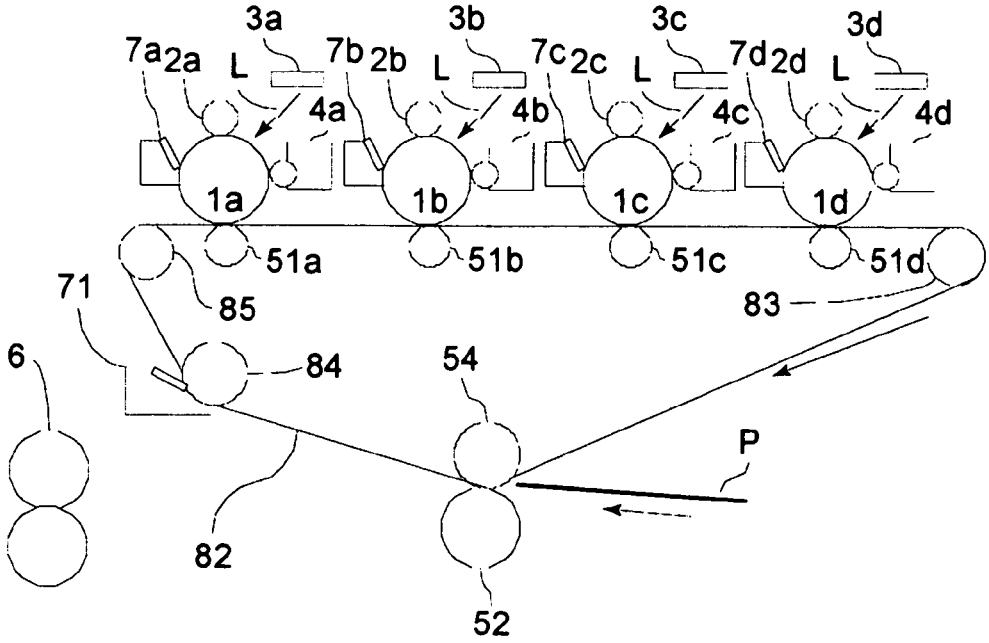
FIG. 7 is a schematic sectional view of the image forming apparatus in the sixth embodiment of the present invention.

FIG. 7 is a drawing showing the sixth embodiment of the present invention. Next, the sixth embodiment will be described with reference to the drawing.

Along the intermediary transfer belt 81 as a toner image bearing moving member, four image forming stations are disposed in tandem. In each image formation station, an exposing apparatus, a charge roller, a developing apparatus, and a cleaning apparatus are disposed around the peripheral surface of the photosensitive drum.

The photosensitive drum 1*a* is 24 mm in diameter, and is charged by the charge roller 2*a*. The charged photosensitive drum 1*a* is exposed by the exposing apparatus 3*a* to form a latent image of a first color, or yellow color, on the peripheral surface of the photosensitive drum 1*a*. The latent image on the photosensitive drum 1*a* is developed by the developing apparatus 4*a* which corresponds in development color to the first color, or yellow. The developed yellow toner image is transferred onto the intermediary transfer belt 81 by the primary transfer roller 51*a*. Meanwhile, the formation of the toner image of a second color, or magenta, begins in the second image forming station having the photosensitive drum 1*b*, so that the second color toner image will be layered on the yellow toner image on the intermediary transfer belt 81, in alignment therewith in term of the direction perpendicular to the plane of the yellow toner image. The image formation on the photosensitive drum 1*b* is virtually the same as the above described formation of the toner image of the first color, or yellow. That is, the photosensitive drum 1*b* is charged by the charge roller 2*b*. The charged photosensitive drum 1*b* is exposed by the exposing apparatus 3*b* to form a latent image of a second color, or magenta color, on the peripheral surface of the photosensitive drum 1*b*. The latent image on the photosensitive drum 1*b* is developed by the developing apparatus 4*b* which corresponds in development color to the second color, or magenta. The developed magenta toner image is transferred onto the intermediary transfer belt 81 by the primary transfer roller 51*b*, so that its position on the belt 81 coincides with the position of the toner image of the first color, or yellow. Similarly, the toner image formed on the photosensitive drum 1*c* and the toner image formed on photosensitive drum 1*d* are transferred by the primary transfer rollers 51*c* and 51*c*, respectively, onto the intermediary transfer belt 81 so that the toner images are sequentially layered onto the preceding images, in alignment therewith. As a result, a full-color image is formed on the intermediary transfer belt 81.

As the full-color image is formed by layering in alignment the four monochromatic images different in color, a recording medium P is conveyed to the contact area between the secondary transfer roller 54 and intermediary transfer belt 81, and is conveyed through the contact area, in synchronism with the movement of the toner images on the intermediary transfer belt 81. As the recording medium P is conveyed through the contact area, the four color toner images on the intermediary transfer belt 81 are transferred all at once onto the recording medium P. Then, the four color toner images on the recording medium P are welded (fixed) to the recording medium by the head and pressure applied thereto by the fixing apparatus 6, yielding a permanent full-color image.

The toner particles remaining on the photosensitive drums 1*a*, 1*b*, 1*c*, and 1*d* after the primary transfer are removed by the cleaning apparatuses 7*a*, 7*b*, 7*c*, and 7*d* in the form of a blade, respectively. The toner particles remaining on the intermediary transfer belt 81 after the secondary transfer are removed by the cleaning apparatus 71 also in the form of a blade.

The material for the intermediary transfer belt 81 is roughly 100 μm thick film formed of polyimide resin, coated with fluoride. Its volume resistivity is in the range of $10^9$ Ω·cm–$10^{10}$ Ω·cm. The volume resistivity of the intermediary transfer belt 81 was measured with the use of HAIRESTAA UP MCP-HT450 (product of Mitsubishi Petrochemical Co., Ltd.). The probe was UR-100, and the applied voltage was 1.0 kv. Instead of polyimide resin, multilayer film formed of one of the various rubbers, for example, EPDM, NBR, Si, chloroprene rubber, hydrin rubber, etc., the volume resistivity of which are in the range of $10^4$ Ω·cm–$10^9$ Ω·cm, and the thicknesses of which are in the range of 0.5 mm–3 mm, may be used as the material for the intermediary transfer belt 81. When one of these rubbers is used as the material for the substrate of the intermediary transfer belt 81, the substrate layer of the intermediary transfer belt 81 is to be reinforced by providing the substrate layer with a core having a substantial amount of mechanical strength, and is to be coated with fluorinated resin or the like to provide the intermediary transfer belt 81 with a surface layer, which is very high in electrical resistance, or dielectric, more specifically, a surface layer, which is 5–50 μm in thickness and no less than $10^{12}$ Ω·cm in volume resistivity.

As the primary transfer rollers 51*a*, 51*b*, 51*c*, and 51*d*, the ion conductive rollers in accordance with the present invention, the volume resistivities of which have been adjusted to the values in the range of $10^7$ Ω·cm–$10^8$ Ω·cm are used. As the secondary transfer roller 52, the ion conductive rollers in accordance with the present invention, the volume resistivity of which has been adjusted to the values in the range of $10^8$ Ω·cm–$10^9$ Ω·cm is used.

With the employment of these ion conductive rollers in accordance with the present invention, it was possible to prevent the outward and inward surfaces of the intermediary transfer belt 81 from being contaminated. Therefore, the performance of the image forming apparatus could be kept stable in terms of the primary and secondary transfers, for a long time.

The primary transfer rollers 51*a*, 51*b*, 51*c*, and 51*d* comprised an aluminum core with an external diameter of 6 mm, and a spongy elastic layer formed of the blend of NBR and ECO rubbers, on the peripheral surface of the aluminum core so that the overall diameter of the primary transfer roller became 14 mm. They were kept in contact with the intermediary transfer belt 81 with the application of 500 g of pressure. If ion conductive rollers other than the ion conductive rollers in accordance with the present invention are used as the primary transfer rollers 51*a*, 51*b*, 51*c*, and 51*d*, it is possible that the surface of the intermediary transfer belt 81 will be so seriously contaminated, being thereby changed in transfer properties, by the seepage from the primary transfer rollers 51*a*, 51*b*, 51*c*, and 51*d* that the traces of the nips formed on the intermediary transfer belt 81 by the primary transfer rollers 51*a*, 51*b*, 51*c*, and 51*d*, and the intermediary transfer belt 81, can be recognized across the toner images transferred onto the intermediary transfer belt 81. More specifically, if ion conductive rollers other than the ion conductive rollers in accordance with the present invention are used as the primary transfer rollers 51*a*, 51*b*, 51*c*, and 51*d*, the ingredients having seeped out of the rollers 51*a*, 51*b*, 51*c*, and 51*d* form pieces of film, on the inward surface of the intermediary transfer belt 81, which affect the condition under which the intermediary transfer belt 81 is charged from the inward thereof. Further, the contamination, that is, film formation, on the inward surface of the intermediary transfer belt 81, affects the overall electrostatic capacity of the intermediary transfer belt 81. Thus, in the advanced stage of the contamination on the inward surface of the intermediary transfer belt 81, the overall electrostatic capacity of the intermediary transfer belt 81 is substantially different from the initial electrostatic capacity of the intermediary transfer belt 81, affecting therefore the charging of the intermediary transfer belt 81 from the outward surface thereof as well.

As for the secondary transfer roller 52, it is placed in contact with the outward surface of the intermediary transfer belt 81 with the application of 1,000 g of pressure. In particular, in the case of the image forming apparatus in this embodiment, which is of the so-called tandem type, the secondary transfer roller 52 is always kept in contact with the intermediary transfer belt 81. In this embodiment, an ion conductive roller in accordance with the present invention is used as the secondary transfer roller 52. Therefore, there will be virtually no seepage from the secondary transfer roller onto the intermediary transfer belt 81. Therefore, the image forming apparatus in this embodiment can continuously forms images of good quality for a long time. If an ion conductive roller other than an ion conductive roller in accordance with the present invention is used as the secondary transfer roller 52, it is possible that the ingredients of the secondary transfer roller 52 will seep out, and contaminate the outward surface of the intermediary transfer belt 81, changing thereby the condition under which the intermediary transfer belt 81 is charged from the outward surface side. Further, the contamination of the outward surface of the intermediary transfer belt 81 adversely affects the primary transfer processes in which the toner images are transferred onto the outward surface of the intermediary transfer belt 81 from the photosensitive drums 1*a*, 1*b*, 1*c*, and 1*d* as image bearing members. In other words, the contamination of the intermediary transfer belt 81 causes the settings of the transfer system to deviates from the optimal ones, that is, the original settings to which the transfer system has been initially set by design, which in turn results in the formation of inferior images.

In this embodiment, however, the problem that the intermediary transfer belt 81 is contaminated on both surfaces is prevented for a long period of time, making it possible to continuously obtain images of good quality for a long period of time. In addition, the employment of the ion conductive roller in accordance with the present invention, as the secondary transfer roller, which not only transfers images, but also conveys the transfer member, which is a moving member, makes the image forming stable in terms of the transfer medium conveyance. Therefore, when a toner image is transferred from a photosensitive drum onto a transfer medium, the toner image does not stretch or shrink, and the transfer medium is not contaminated by the seepage from the secondary transfer roller 52.

In this embodiment, the image forming apparatus is provided with a plurality of image forming station, and is structured so that a full-color image can be completed while the intermediary transfer belt 81 is rotated one full turn. However, an ion conductive roller in accordance with the present invention is also applicable to an image forming apparatus structured so that the intermediary transfer belt thereof are to be rotated plural number of times to form a single full-color image. Obviously, the length of time such an image forming apparatus that employs an ion conductive roller in accordance with the present invention as the secondary transfer roller thereof can yield images of good quality is substantially longer than the length of time such an image forming apparatus that employs, as the secondary transfer roller thereof, an ion conductive roller other than an ion conductive roller in accordance with the present invention. Such an image forming apparatus must be structured so that the secondary transfer roller 52 can be kept separated from the cleaning apparatus 7 while the intermediary transfer belt 81 is rotated plural number of times to form a full-color image. However, there are still the opportunities for the secondary transfer roller 52 to contact the intermediary transfer belt 81. Therefore, even in the case of such an image forming apparatus, the employment of an ion conductive roller in accordance with the present invention as a secondary transfer roller is beneficial from the standpoint of preventing the contamination of the intermediary transfer belt 81.

Embodiment 7

Figure 8:
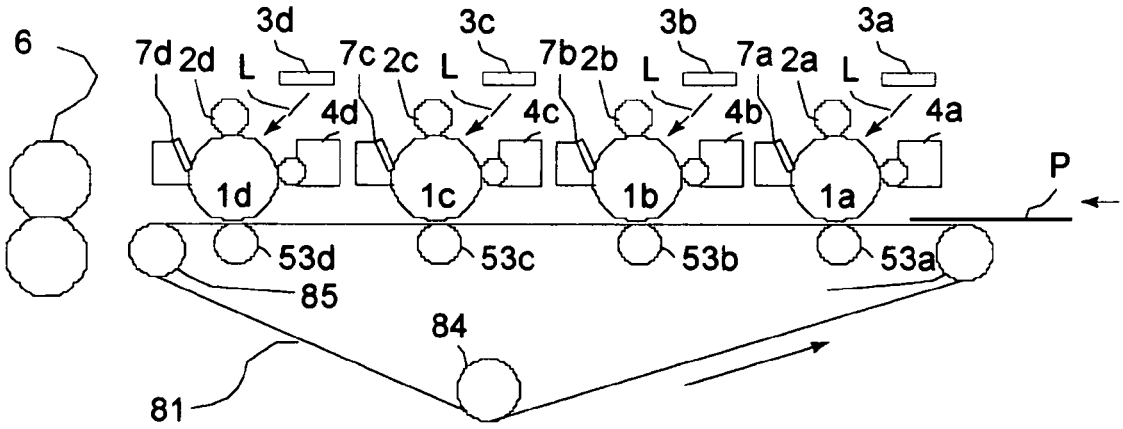
FIG. 8 is a schematic sectional view of the image forming apparatus in the seventh embodiment of the present invention.
Figure 9:
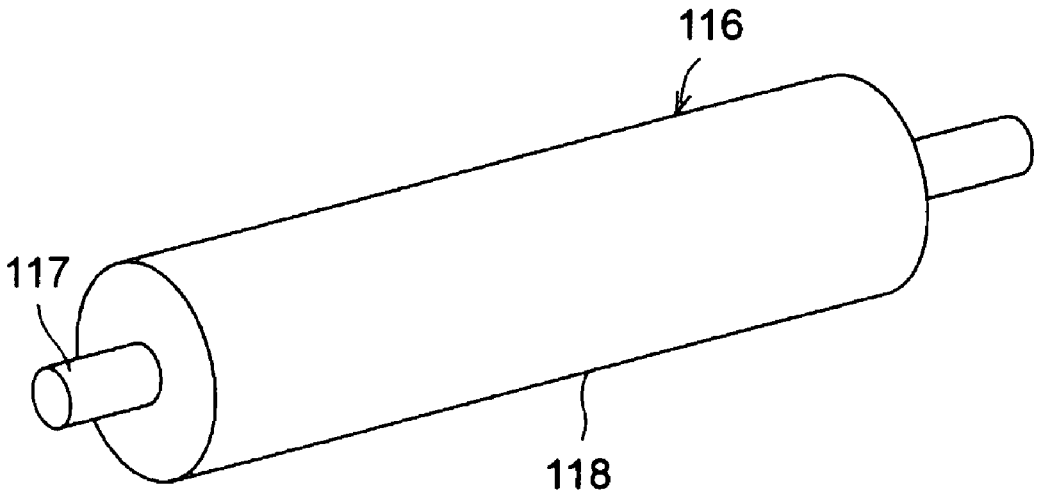
FIG. 9 is a perspective view of a typical electrically conductive roller in accordance with the prior art.

FIG. 8 is a drawing showing the seventh embodiment of the present invention. Next, the seventh embodiment will be described with reference to the drawing.

Along the transfer medium conveyance belt 82 as a moving member, four image forming stations are placed in tandem. In each image formation station, an exposing apparatus, a charge roller, a developing apparatus, and a cleaning apparatus are disposed around the peripheral surface of the photosensitive drum.

The photosensitive drum 1*a* is 24 mm in diameter, and is charged by the charge roller 2*a*. The charged photosensitive drum 1*a* is exposed by the exposing apparatus 3*a* to form a latent image of a first color, or yellow color on the peripheral surface of the photosensitive drum 1*a*. The latent image on the photosensitive drum 1*a* is developed by the developing apparatus 4*a* which corresponds in development color to the first color, or yellow. The developed yellow toner image is transferred onto the transfer medium P on the transfer medium conveyance belt 82 by the primary transfer roller 53*a*. Meanwhile, the formation of the toner image of a second color, or magenta, begins in the second image forming station having the photosensitive drum 1*b*, so that the second color toner image will be layered on the yellow toner image on the transfer medium P on the transfer medium conveyance belt 82, in alignment therewith in term of the direction perpendicular to the plane of the yellow toner image. The image formation on the photosensitive drum 1*b* is virtually the same as the above described formation of the toner image of the first color, or yellow. That is, the photosensitive drum 1*b* is charged by the charge roller 2*b*. The charged photosensitive drum 1*b* is exposed by the exposing apparatus 3*b* to form a latent image of a second color, or magenta color, on the peripheral surface of the photosensitive drum 1*b*. The latent image on the photosensitive drum 1*b* is developed by the developing apparatus 4*b* which corresponds in development color to the second color, or magenta. The developed magenta toner image is transferred onto the transfer medium P on the transfer medium conveyance belt 82 by the primary transfer roller 51*b*, so that its position on the transfer medium P on the belt 82 coincides with the position of the toner image of the first color, or yellow, on the transfer medium P on the belt 82. Similarly, the toner image formed on the photosensitive drum 1*c* and the toner image formed on photosensitive drum 1*d* are transferred by the primary transfer rollers 51*c* and 51*d*, respectively, so that the toner images are sequentially layered onto the preceding images on the transfer medium P on the transfer medium conveyance belt 82, in alignment therewith. As a result, a full-color image is formed on the transfer medium P on the transfer medium conveyance belt 82.

After the full-color image is formed on the transfer medium P by layering thereon in alignment the four monochromatic images different in color, the recording medium P is separated from the transfer medium conveyance belt 82, and is conveyed to the fixing apparatus 6, in which the four color toner images on the transfer medium P welded (fixed) to the transfer medium P, yielding a permanent full-color image.

The toner particles remaining on the photosensitive drums 1*a*, 1*b*, 1*c*, and 1*d* after the primary transfer are removed by the cleaning apparatuses 7*a*, 7*b*, 7*c*, and 7*d* in the form of a blade, respectively. The fog causing toner particles having been transferred onto the transfer medium conveyance belt 82 are removed by the cleaning apparatus 71 also in the form of a blade.

As the material for the transfer medium conveyance belt 82, 50 μm–200 μm thick film formed of resinous substance such as PI, PVDF, ETFE, ABS, polycarbonate, Nylon, etc., the electrical resistance of which has been optimized, may be used. In the case of the transfer medium conveyance belt 82 in this embodiment, the surface resistivity is in the range of $10^7$ Ω/–$10^{12}$ Ω/, and the volumetric resistivity is in the range of $10^7$ Ω·cm–$10^{12}$ Ω·cm. The surface and volume resistivities of the transfer medium conveyance belt 82 were measured with the use of HAIRESTAA UP MCP-HT450 (product of Mitsubishi Petrochemical Co., Ltd.). The probe was UR-100, and the applied voltage was 1.0 kv. Instead of the above listed resinous substances, multilayer film formed of one of the various rubbers, for example, EPDM, NBR, Si, chloroprene rubber, hydrin rubber, etc., the volume resistivity of which are in the range of $10^4$ Ω·cm–$10^9$ Ω·cm, and the thicknesses of which are in the range of 0.5 mm–3 mm, may be used as the material for the transfer medium conveyance belt 82. When one of these rubbers is used as the substrate layer of the transfer medium conveyance belt 82, the substrate layer of the transfer medium conveyance belt 82 is to be reinforced by providing the substrate layer with a core having a substantial amount of mechanical strength, and is to be coated with fluorinated resin or the like to provide the transfer medium conveyance belt 82 with a surface layer, which is very high in electrical resistance, or dielectric, more specifically, a surface layer, which is 5–40 μm in thickness, and no less than $10^{12}$ Ω·cm in volume resistivity.

In this embodiment, roughly 70 μm thick film formed of PI resin, the surface and volume resistivities of which have been adjusted to roughly $10^9$ Ω/ and $10^{10}$ Ω·cm, respectively, was used as the material for the transfer medium conveyance belt 82.

As the primary transfer rollers 53*a*, 53*b*, 53*c*, and 53*d*, the ion conductive rollers in accordance with the present invention, the volume resistivity of which had been adjusted so that their values fall within the range of $10^7$ Ω·cm–$10^8$ Ω·cm were employed.

With the employment of these ion conductive rollers in accordance with the present invention, it was possible to prevent the inward surface of the transfer medium conveyance belt 82 from being contaminated. Therefore, the performance of the image forming apparatus could be kept stable for a long time in terms of image transfer.

The transfer rollers 53*a*, 53*b*, 53*c*, and 53*d* are always kept in contact with the transfer medium conveyance belt 82 with the application of 500 g of pressure. If ion conductive rollers other than ion conductive rollers in accordance with the present invention are used as the transfer rollers 53*a*, 53*b*, 53*c*, and 53*d*, it is possible that the ingredients of the transfer rollers 53*a*, 53*b*, 53*c*, and 53*d* will seep out, and contaminate the inward surface of the transfer medium conveyance belt 82, changing thereby so seriously the condition under which toner images are transferred onto the transfer medium P on the transfer medium conveyance belt 82 that the traces of the nips formed between the transfer rollers 53*a*, 53*b*, 53*c*, and 53*d* and transfer medium conveyance roller 82 can be detected across the toner images formed on the surface of the transfer medium P on the transfer medium conveyance belt 82. The seepage from the ion conductive rollers, other than ion rollers in accordance with the present invention, used as the transfer rollers 53*a*, 53*b*, 53*c*, and 53*d*, form films on the inward surface of the transfer medium conveyance belt 82, and these films change the condition under which the transfer medium conveyance belt 82 is charged, in particular, from the inward side.

In this embodiment, however, ion conductive rollers in accordance with the present invention are employed as the transfer rollers 53*a*, 53*b*, 53*c*, and 53*d*. Therefore, the problem that the transfer medium conveyance belt 82 is contaminated on both surfaces is kept under control for a long time, making it possible to produce images of good quality for a long time.

Although the present invention was described above with reference to the first to seventh embodiments, these embodiments are not intended to limit the scope of the present invention. In other words, these applications are intended to cover such modifications or changes, for example, a multilayer roller or the like, as may come within the purposes of the improvements or the scope of the following claims.

What is claimed is:

1. An image forming apparatus comprising:

a movable member;

a roller in contact with said movable member, said roller having an elastic layer comprising a foam in contact with said movable member, said elastic layer having an ion electroconductivity and having a hardness of not less than 20° and not more than 50°, wherein the hardness and a density (g/cm$^3$) of said elastic layer satisfy (hardness/density) ≧65, wherein the hardness is an Asker-C hardness of a material of said elastic layer cut out into a thickness of 4.0 mm under a weight of 500 g applied to the material.

2. An apparatus according to claim 1, wherein said movable member is an image bearing member.

3. An apparatus according to claim 1, wherein said movable member is a transfer material.

4. An apparatus according to claim 1, wherein said movable member is a transfer member for carrying a transfer material.

5. An apparatus according to claim 1, wherein said roller electrically charges said movable member.

6. An apparatus according to claim 1, wherein a surface of said roller in contact with said movable member has been abraded.

7. An apparatus according to claim 1, wherein said elastic layer does not exhibit a bridging density change by illumination with ultraviolet radiation.

8. An apparatus according to claim 1, wherein said elastic layer has been produced using a thiuram type vulcanization promoter.

9. An apparatus according to claim 1, wherein an azodicarbonamide is employed to produce the elastic layer.

10. An apparatus according to claim 1, wherein said elastic layer comprises epichiorohydrin-ethylene oxide rubber as a main material.

11. An apparatus according to claim 1, wherein said elastic layer comprises acrylonitrile butadiene rubber as a main material.

12. A roller for contacting a movable member, comprising:

an elastic layer comprising a foam provided on a surface layer;

said elastic layer having an ion electroconductivity and having a hardness of not less than 20° and not more than 50°, wherein the hardness and a density (g/cm$^3$) of said elastic layer satisfy (hardness/density) ≧65, wherein the hardness is an Asker-C hardness of a material of said elastic layer cut out into a thickness of 4.0 mm under a weight of 500 g applied to the material.

13. A roller according to claim 12, wherein said movable member is an image bearing member.

14. A roller according to claim 12, wherein said movable member is a transfer material.

15. A roller according to claim 12, wherein said roller electrically charges said movable member.

16. A roller according to claim 12, wherein said movable member is a transfer member for carrying a transfer material.

17. A roller according to claim 12, wherein a surface of said roller for contact with said movable member has been abraded.

18. A roller according to claim 12, wherein said elastic layer does not exhibit a bridging density change by illumination with ultraviolet radiation.

19. A roller according to claim 12, wherein said elastic layer has been produced using a thiuram vulcanization promoter.

20. A roller according to claim 12, wherein an azodicarbonamide is employed to produce the elastic layer.

21. A roller according to claim 12, wherein said elastic layer comprises epichlorohydrin-ethylene oxide rubber as a main material.

22. A roller according to claim 12, wherein said elastic layer comprises acrylonitrile butadiene rubber as a main material.

* * * * *

UNITED STATES PATENT AND TRADEMARK OFFICE

CERTIFICATE OF CORRECTION

PATENT NO. : 7,187,890 B2
APPLICATION NO. : 10/807105
DATED : March 6, 2007
INVENTOR(S) : Satoshi Nishida It is certified that error appears in the above-identified patent and that said Letters Patent is hereby corrected as shown below:

COLUMN 24

Line 24, "epichiorohydrin-ethylene" should read --epichlorohydrin-ethylene--.

Signed and Sealed this

Twenty-fifth Day of December, 2007

JON W. DUDAS
*Director of the United States Patent and Trademark Office*